United States Patent [19]

Glynn

[11] 4,437,460

[45] Mar. 20, 1984

[54] BREATHING APPARATUS

[75] Inventor: Michael H. Glynn, Basingstoke, England

[73] Assignee: Sabre Safety Limited, England

[21] Appl. No.: 308,993

[22] Filed: Oct. 6, 1981

[30] Foreign Application Priority Data

Oct. 17, 1980 [GB] United Kingdom ..... 8033674

[51] Int. Cl.[3] ..... A62B 7/04

[52] U.S. Cl. ..... 128/204.26; 128/205.24; 137/513.7; 137/DIG. 9

[58] Field of Search ..... 128/204.26, 204.27, 128/205.24, 207.16; 137/DIG. 9, 513.7

[56] References Cited

U.S. PATENT DOCUMENTS 3,028,860 4/1962 Gagnan et al. ..... 128/204.26 X
4,178,961 12/1979 Warncke ..... 128/204.26 X

FOREIGN PATENT DOCUMENTS 633413 12/1949 United Kingdom .
640269 7/1950 United Kingdom .
931968 7/1963 United Kingdom ..... 137/DIG. 9
969280 9/1964 United Kingdom ..... 128/204.26
1367286 9/1974 United Kingdom .

*Primary Examiner*—Lee S. Cohen
*Attorney, Agent, or Firm*—Bacon & Thomas

[57] ABSTRACT

A single stage demand valve for passing air from a cylinder of compressed air to a face mask includes a main valve member and a by-pass valve. The by-pass valve is provided to deliver air to the face mask should the main valve member stick or seize in the closed position. The by-pass valve is a constant pressure reduction valve, having a valve member in the form of a piston, whereby variations in air pressure in the breathable gas from the cylinder are compensated ensuring that the desired flow rate or air through the by-pass valve is maintained without repeated adjustment of the by-pass valve, as in the prior art.

4 Claims, 2 Drawing Figures

BREATHING APPARATUS

BACKGROUND OF THE INVENTION

This invention relates to breathing apparatus and in particular to demand valves for single stage breathing apparatus.

Breathing apparatus with which the invention is used comprises a cylinder containing a compressed breathable gas (usually air) and a face mask. The user carries the cylinder on his back and wears the face mask, the air being supplied from the cylinder to the face mask. Attached to the face mask is a demand valve which passes the compressed air, at a breathable pressure, from the cylinder to the face mask when the wearer of the face mask inhales and "demands" air. Breathing apparatus of this type is termed single stage if the pressure of the compressed air in the cylinder is reduced to a breathable pressure in the demand valve in a single stage. Such demand valves are often called single stage demand valves.

A further kind of demand valve is known as a second stage demand valve or regulator because the pressure of the compressed air in the cylinder is reduced to a substantially constant intermediate pressure, typically 100 to 120 p.s.i., air at this intermediate pressure then being fed to the second stage demand valve which reduces the air pressure to a breathable pressure. However, as noted above the invention is concerned with single stage demand valves.

The invention aims to provide a single stage demand valve which allows an emergency supply of breathing gas to pass through the demand valve should the valve member of the demand valve stick or seize in the closed condition. Provision of such an emergency by-pass is obligatory in some countries, notably the United States.

Prior demand valves have by-pass valves which are single on/off valves having a movable valve member providing metering of the air flow. Air at cylinder pressure enters the by-pass valve, which reduces the air pressure to a suitable flow in dependence upon the degree of opening of the by-pass valve. As time passes, the pressure in the cylinder falls and the emergency air flow to the wearer falls proportionately. Therefore, the wearer must repeatedly adjust the opening of the by-pass valve to obtain the desired air flow.

The invention aims to provide a single stage demand valve which renders this repeated adjustment unnecessary by, in effect, compensating for the falling pressure in the air cylinder.

SUMMARY OF THE INVENTION

According to the invention a demand valve for a single stage breathing apparatus comprises an inlet for admission of compressed breathable gas, an outlet for connection to a face mask, a valve seating, a valve member urged into engagement with the valve seating, means for moving the valve member away from the seating when suction is applied to the outlet, to enable the breathable gas to pass from the inlet to the outlet, and by-pass means enabling the breathable gas to by-pass the valve member and seating and thereby reach the outlet to provide an emergency supply of breathable gas in the event of the valve member becoming lodged in the closed position, wherein the by-pass means comprise a constant pressure reduction valve which when open reduces the pressure of the compressed breathable gas to a valve within a predetermined range having a percentage variation from a mean smaller than the percentage variation of the pressure of the breathable gas supplied to the inlet, and wherein the by-pass means also include a flow passage sized to allow a predetermined volumetric flow rate of breathable gas, at said value of pressure within the predetermined range, to reach the outlet.

Hence, with the inventive demand valve as the cylinder empties and the pressure of the compressed gas therein progressively falls, the pressure of the gas fed to the outlet via the by-pass means varies far less than the variation in the cylinder pressure, to provide the compensation mentioned.

The by-pass means preferably additionally comprise a manually adjustable control member movable between a normal inoperative position in which the by-pass means are closed and an emergency operative position in which the by-pass means are open, the control member being continuously adjustable between its normal inoperative and emergency operative positions so that the flow rate of breathable gas through the by-pass means can be varied between zero and said predetermined volumetric flow rate.

DESCRIPTION OF THE PREFERRED EMBODIMENT

Figure 1:
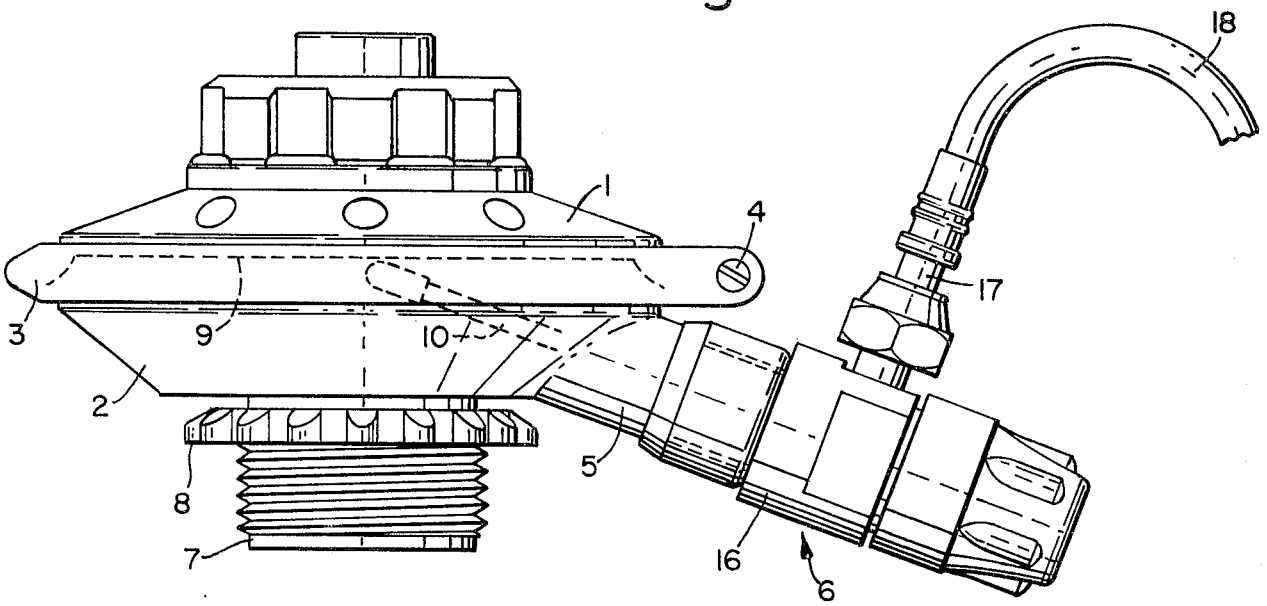
FIG. 1 is a side view of a preferred demand valve.

Referring to FIG. 1, the demand valve has two plastics body parts 1 and 3 of generally dished shape secured together at their outer peripheries by a clamping ring 3 secured by a clamping screw 4. The body part 2 is integrally moulded with a cylindrical spigot 5 which receives the sub-assembly 6 of components shown in FIG. 2. The body part 2 is also formed with a cylindrical outlet 7 having a threaded ring 8 for attaching the demand valve to the inlet of a face mask (not shown).

Figure 2:
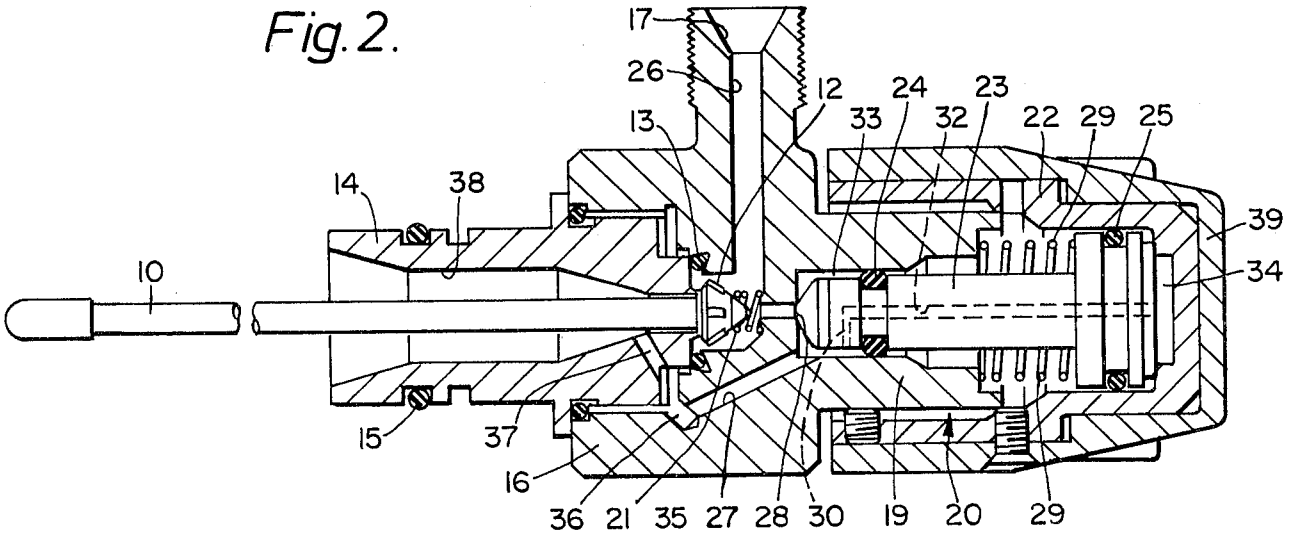
FIG. 2 is a sectional view showing the inventive portion of the demand valve.

Between the two body parts 1 and 2 there is clamped at its periphery a diaphragm 9 engaged by one end of a valve stem 10 which extends through the cylindrical spigot 5 and carries at its end remote from the diaphragm 9 a nylon valve member 12 of generally frustoconical shape. The valve stem 10 and the valve member 12, together with the remaining inventive portion of the demand valve, are shown in FIG. 2 to which reference will now be made.

The valve member 12 cooperates with a valve seating 13 formed in a generally tubular phosphor bronze body 14 which is fitted within the spigot 5 and is sealed therein by means of an O-ring 15. The phosphor bronze body 14 is threaded within a brass elbow 16 having an inlet 17 for attachment to a flexible high pressure pipe 18 (FIG. 1) supplying compressed air from a high pressure cylinder (not shown). A sleeve-like extension 19 of the elbow 16 is threaded on its outer periphery at 20 and receives an internally threaded metal end cap 22. Between the end cap 22 and the sleeve-like extension 19 there is defined an internal cavity within which is positioned a piston 23 sealed by an O-ring 24 with respect to the internal wall of the sleeve-like extension 19 and by an O-ring 25 with respect to the inner end of the end cap 22.

The inlet 17 leads into an inlet passage 26 the inner end of which (and lower end as viewed in FIG. 2) branches in opposite directions. The left-hand branch as viewed in FIG. 2 leads towards the valve seating 13 whilst the right-hand branch leads into a central bore 27 terminating in an orifice 28 which is normally closed by the adjacent end of the piston 23. The piston 23 is held in this normal, closed position by the end cap 22 which in its normal position illustrated in FIG. 2 is screwed on to the sleeve-like extension 19 sufficiently for the left-hand end of the piston to close the orifice 28. The piston 23 is biased towards the right by a helical compression spring 29 which moves the piston 23 to open the orifice 28 when the end cap 22 is slackened. The piston 23 is formed with a radial passage 30 communicating with a central bore 32 so that compressed air which passes through the open orifice 28 and into the chamber 33 surrounding the left-hand end of the piston 23 is led through the radial passage 30 and central bore 32 to a space 34 between the right-hand end of the piston and the end cap 22. The chamber 33 also communicates with an inclined passage 35 formed in the elbow 16, this passage 35 communicating with an annular space 36 defined between the elbow 16 and the phosphor bronze body 14. A passage 37 interconnects the annular space 36 and the central bore 38 in the phosphor bronze body 14, this passage 37 being accurately sized in order to allow a predetermined volumetric flow rate of compressed air to pass through in use.

The end cap 22 has attached thereto by a locking screw a plastics turning knob 39 which provides a control member rotation of which varies the position of the piston 23 with respect to the orifice 28, as previously described.

The described demand valve has a spring which can be brought, at the option of the wearer, to bear against the diaphragm 9 in order to bias the latter so that the air pressure applied to the face mask is always slightly above atmospheric pressure.

It will be appreciated that the piston 23 serves as a valve element for the constant pressure reduction valve which controls the flow of compressed air through the orifice and thence through the by-pass means constituted by the chamber 33, the inclined passage 35, the annular space 36 and the sized passage 37. It will also be noted that the piston 23 is movable in a direction which is perpendicular to the inlet passage 26 and aligned with the bore 38 in the body 14.

In normal use of the demand valve, compressed air admitted to the inlet 17 urges the valve member 12 against its seating 13, there being in addition a spring 21 to cause positive closure of the demand valve. Suction applied to the outlet 7 as a result of inhalation causes flexure of the diaphragm 9, consequent rocking of the valve stem 10 and tilting of the valve member 12. This unseats the latter so as to allow compressed air to pass from the inlet 17, between the valve member 12 and the valve seating 13, (with reduction in pressure) through the central bore 38 in the phosphor bronze body 14, and thence out of the outlet 7 and into the face mask. During this normal operation, the control knob 29 is in its normal position, holding the piston 23 against the orifice 28 to close the latter. Should the valve member 12 become lodged in the closed position (for example because of dirt or any other obstruction to opening) the user can rotate the control knob 39 from its normal position to an emergency position to obtain an emergency supply of air to the face mask. The control knob 39 is continuously adjustable between its normal position and its emergency position, so that the flow rate of air through the by-pass means can be controlled, if desired.

When the control knob 39 has been rotated to its emergency position (typically through about one half turn), it allows the piston 23 to move to the right as viewed in FIG. 2 under the influence of the spring 29, allowing compressed air to pass through the orifice 28 and into the chamber 33 whence it reaches the bore 38 in the phosphor bronze body 14 by way of the inclined passage 35, the annular space 36 and the sized passage 37. Compressed air also reaches the space 34 and, because the cross-sectional area of the space 34 is larger than the cross-sectional area of the chamber 33, the compressed air tends to move the piston 23 towards the left as viewed in FIG. 2 against the influence of the compression spring. As a result, when the pressure rises in the chamber 33 the piston 23 tends to close against the orifice 28, whilst if the pressure falls in the chamber 33 the piston 23 tends to move away from the orifice 28. This control of the position of the piston has the effect of providing a substantially uniform pressure in the chamber 33 so long as the knob is left in the fully open position, regardless of whether the cylinder of compressed air is full or nearly empty. The emergency flow of air thus occurs from a region at which the pressure is held substantially constant (the chamber 33) and through the passage 37 which is sized to allow a predetermined flow rate. As a result, the flow of air through the by-pass means is kept substantially uniform, a notable improvement on prior arrangements.

This is shown by the following comparative example:

(1) A typical air cylinder contains 1300 liters of free air at 2200 p.s.i.

(2) The wearer breaths at an average consumption rate of 40 liters per minute (i.e. 2 liters/breath×20 breaths/min. Peak inspiratory flow 120 l/m).

(3) When the pressure of air in the cylinder falls to about 500 p.s.i. a warning whistle sounds to tell the wearer it is time to come out.

(4) When the demand valve fails in the closed position, the by-pass valve has to supply at least 120 l/m during the working phase of the duration (i.e. between 2200 p.s.i. and 500 p.s.i.).

(5) On a conventional by-pass valve, if the valve was not to be readjusted during this time, the initial flow setting would have to be approximately:

$$(2200/500)\times 120=528 \text{ l/m.}$$

This would obviously be very wasteful in air and so reduce the wearer's escape time.

(6) With the described embodiment of valve, the by-pass flow is controlled to a substantially constant flow by the use of the miniature pressure reducing valve and fixed orifice or passage 37. The miniature valve reduces the air pressure in the cylinder from:
2200 p.s.i.g. to about 80 p.s.i.g. and
500 p.s.i.g. to about 50 p.s.i.g.

(7) By virtue of the fixed orifice or passage 37 the flows will be proportional to absolute pressure:
The flow at (50+14.7) p.s.i.a. is 120 l/m
The flow at (80+14.7) p.s.i.a. is $120\times(94.7/64.7)=175.6$ l/m.

This shows that a variation in cylinder pressure between 2200 p.s.i.g. and 500 p.s.i.g. gives a corresponding variation in breathing pressure between 80 p.s.i.g. and 50 p.s.i.g., and a corresponding variation in flow rate between 120 l/m and 175.6 l/m. The variations in breathing pressure and flow rate are far less, in terms of percentage variation from a mean, than the variation in cylinder pressure.

I claim:

1. In a single stage breathing apparatus, a demand valve comprising a valve body having a diaphragm chamber, an outlet means from said chamber for connection to a face mask, a diaphragm clamped within said chamber and being displaceable by pressure changes therein, and an inlet portion connected to said chamber comprising a plurality of body parts providing an inlet for admission of compressed breathable gas, a valve seating, a valve member urged into engagement with the valve seating, means for moving the valve member away from the seating when suction is applied to the outlet means to enable the breathable gas to pass from the inlet to the outlet means, and by-pass means enabling the breathable gas to by-pass the valve member and seating and thereby reach the outlet means to provide an emergency supply of breathable gas in the event of the valve member becoming lodged in the closed position, the by-pass means including a flow passage sized to allow a predetermined volumetric flow rate of breathable gas at a pressure within a predetermined range, a first chamber communicating with the sized flow passage and an orifice leading from the inlet to said first chamber, and a constant pressure reduction valve comprising a piston, one end of which is adapted to close said orifice leading from the inlet to said first chamber, biasing means urging the piston in a direction to open said orifice, means normally restraining the piston from movement by the biasing means but operable in an emergency to permit movement of the piston to open said orifice, another end of the piston forming a wall of a second chamber having a greater cross-sectional area than the cross-sectional area of the first chamber, and the piston having a bore therethrough communicating said first and second chambers enabling breathable gas under pressure to pass between said first and second chambers to control the pressure of breathable gas in the first chamber within the predetermined range when the constant pressure reduction valve is open.

2. A demand valve according to claim 1, wherein the means normally restraining the piston from movement comprise a manually adjustable control member movable between a normal inoperative position in which the by-pass means are closed and an emergency operative position in which the by-pass means are open, the control member being continously adjustable between its normal inoperative and emergency operative positions.

3. A demand valve according to claim 2, wherein the control member is a rotationally adjustable control knob mounted on the end of a body part of the inlet portion of the demand valve.

4. A demand valve according to claim 2, wherein the control member is rotationally movable about an axis which is perpendicular to the direction of the flow of gas through the inlet and which is substantially aligned with the general direction of the flow of gas past the valve seating.

* * * * *